US005119138A

United States Patent [19]

Oda et al.

[11] Patent Number: 5,119,138

[45] Date of Patent: Jun. 2, 1992

[54] IMAGE FORMING APPARATUS HAVING SIMULTANEOUS CLEANING AND DEVELOPING MEANS

[75] Inventors: Goro Oda, Sagamihara; Teruhiko Enomoto, Yokohama, both of Japan

[73] Assignee: Kabushiki Kaisha Toshiba, Kawasaki, Japan

[21] Appl. No.: 631,427

[22] Filed: Dec. 21, 1990

[30] Foreign Application Priority Data

Dec. 28, 1989 [JP] Japan ..... 1-344412

[51] Int. Cl.[5] ..... G03G 15/06; G03G 21/00

[52] U.S. Cl. ..... 355/269; 355/296; 355/309

[58] Field of Search ..... 355/269, 296, 297, 301, 355/305, 303, 298, 309

[56] References Cited

U.S. PATENT DOCUMENTS 3,646,866 3/1972 Baltazzi et al. ..... 355/305
4,265,998 5/1981 Barkley ..... 355/269
4,800,147 1/1989 Savage ..... 355/269

FOREIGN PATENT DOCUMENTS 1-167871 7/1989 Japan ..... 355/297

*Primary Examiner*—R. L. Moses
*Attorney, Agent, or Firm*—Foley & Lardner

[57] ABSTRACT

An image forming apparatus includes as photoconductive drum, a developing device for developing an electrostatic latent image on the drum with toner and simultaneously removing residual toner particles from the drum, and a transfer unit for transferring the developed image onto a recording medium. A distributing unit is arranged between the transfer unit and the developing device. The distributing unit temporarily attracts the untransferred toner particles remaining on the drum and then releases the attracted toner particles onto the drum, thereby distributing an untransferred toner image on the drum. Recording mediums are fed through a position between the drum and the transfer unit, with such an interval maintained between any two adjacent recording mediums, that the distributing unit is able to fully release the attracted toner particles onto the drum.

10 Claims, 11 Drawing Sheets

GENERALLY DENSE (CENTER IS RICH)

NEGATIVE BIAS

DENSE AT PERIPHERY (CENTER IS BLANK)

OV OR FLOATING

GENERALLY SPARSE

POSITIVE BIAS

IMAGE FORMING APPARATUS HAVING SIMULTANEOUS CLEANING AND DEVELOPING MEANS

BACKGROUND OF THE INVENTION

1. Field of the Invention

The present invention relates to an image forming apparatus using electrophotography, and more particularly, to an image forming apparatus in which the development and cleaning of an image carrier are simultaneously effected by a developing unit.

2. Description of the Related Art

Modern image forming apparatuses of this type are disclosed in, for example, U.S. Pat. Nos. 4,664,504 and 4,834,424. In these apparatuses, a developing process is executed such that a developing unit is used to cause a toner (coloring powder) as a developing agent to adhere to an electrostatic latent image on an image carrier, such as a photoconductor, thereby forming a toner image thereon. Thereafter, the toner image on the image carrier is transferred to a recording medium such as plain paper. After the transfer, residual or untransferred toner particles remaining on the image carrier are removed therefrom by means of the developing unit in the next image forming cycle.

Since the image carrier is thus cleaned by means of the developing unit, in these conventional image forming apparatuses, no exclusive-use cleaner is required for the cleaning, so that the image carrier can be miniaturized. Thus, the whole apparatus can be reduced in size and cost, and improved in maintenance efficiency. Accordingly, there is an urgent need for the apparatus of this type.

In these conventional apparatuses, however, if toner particles remain on the image carrier without being transferred to the recording medium during a transfer process in the preceding image forming cycle, the image carrier is charged and exposed through the untransferred toner particles in the subsequent cycle. As a result, the image carrier suffers uneven charging or exposure, so that undesired images may be produced.

SUMMARY OF THE INVENTION

The present invention has been contrived in consideration of these circumstances. Its object is to provide an image forming apparatus capable of simultaneous development and cleaning of an image carrier, in which undesired images are prevented from being produced due to untransferred toner particles remaining on the image carrier, thus ensuring production of high-quality images, reduction in size and cost of the whole apparatus, and improved maintenance efficiency.

In order to achieve the above object, an apparatus according to the present invention comprises: an image carrier; means for forming an electrostatic latent image on a surface of the image carrier; means for developing the electrostatic latent image and cleaning the image carrier; means for transferring the developed image formed on the image carrier by the developing means to a transfer material; means for distributing any developing agent remaining on the image carrier after the transfer of the developed image; and means for feeding recording mediums through the transferring means, with such a distance maintained between any two adjacent recording medium, that is enough to distribute the developing agent remaining on the image carrier by the distributing means.

According to the apparatus described above, the untransferred developing agent remaining on the image carrier is temporarily removed therefrom and then returned thereto by means of the distributing means, after a transfer process using the transferring means and before a charging process in the next image forming cycle using the charging means. Thus, the untransferred developing agent on the image carrier is leveled, so that the influences of the residual developing agent after the transfer on the charging and exposure processes can be prevented.

Also, the interval of the recording mediums fed through the position between the image carrier and the transferring means, that is, the distance between the trailing end of the recording medium and the leading end of the next recording medium is set to a length larger than the length corresponding to time sufficient to distribute the residual developing agent image on the image carrier by the distributing means. Therefore, the attracted developing agent can be prevented from being accumulated in the distributing means, and thus, the distributing means can stably maintain the distributing function for a long period of time.

This arrangement makes it possible to realize a cleanerless image forming apparatus in which the production of undesired images, due to the residual developing agent used in the preceding image forming cycle, can be prevented, ensuring production of satisfactory images, and the whole apparatus can be reduced in size and cost. The improved in maintenance efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 14 show an image forming apparatus according to an embodiment of the present invention; in which FIG. 1 is a cross sectional view showing the whole apparatus;

FIG. 2 is an enlarged cross sectional view showing an essential part of the apparatus;

FIG. 3 is a perspective view of a memory distributing unit;

FIG. 4 is a cross sectional view taken along line IV—IV in FIG. 3;

FIG. 5 is a cross sectional view of an artificial fiber;

FIG. 6 is a view showing a location of the memory distributing unit with respect to a photoconductive drum;

FIG. 7 is a graph showing change of the surface potential of the photoconductive drum;

FIG. 8 is a graph showing the relationships between the production of memories and various charging potentials;

FIG. 9 is a view showing an example of the memory patterns liable to appear on a transfer paper;

FIG. 11 is a perspective view showing an enlarged part of a pile-weave brush;

FIG. 12 is a cross sectional view showing the part of the pile-weave brush;

FIG. 14 is a schematic side view showing a relationship among the photoconductive drum, the distributing unit, and the interval of the transfer papers.

DETAILED DESCRIPTION OF THE PREFERRED EMBODIMENTS

An embodiment of the present invention will be explained with reference to the accompanying drawings.

Figure 1:
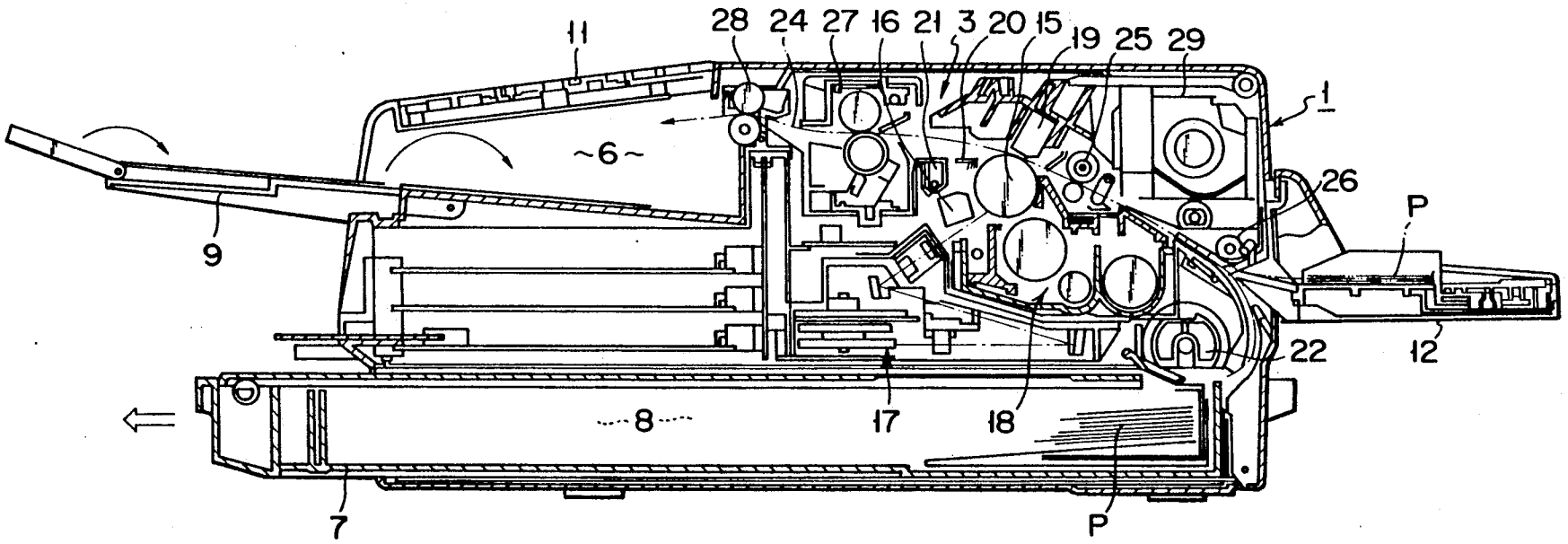
Figure 2:
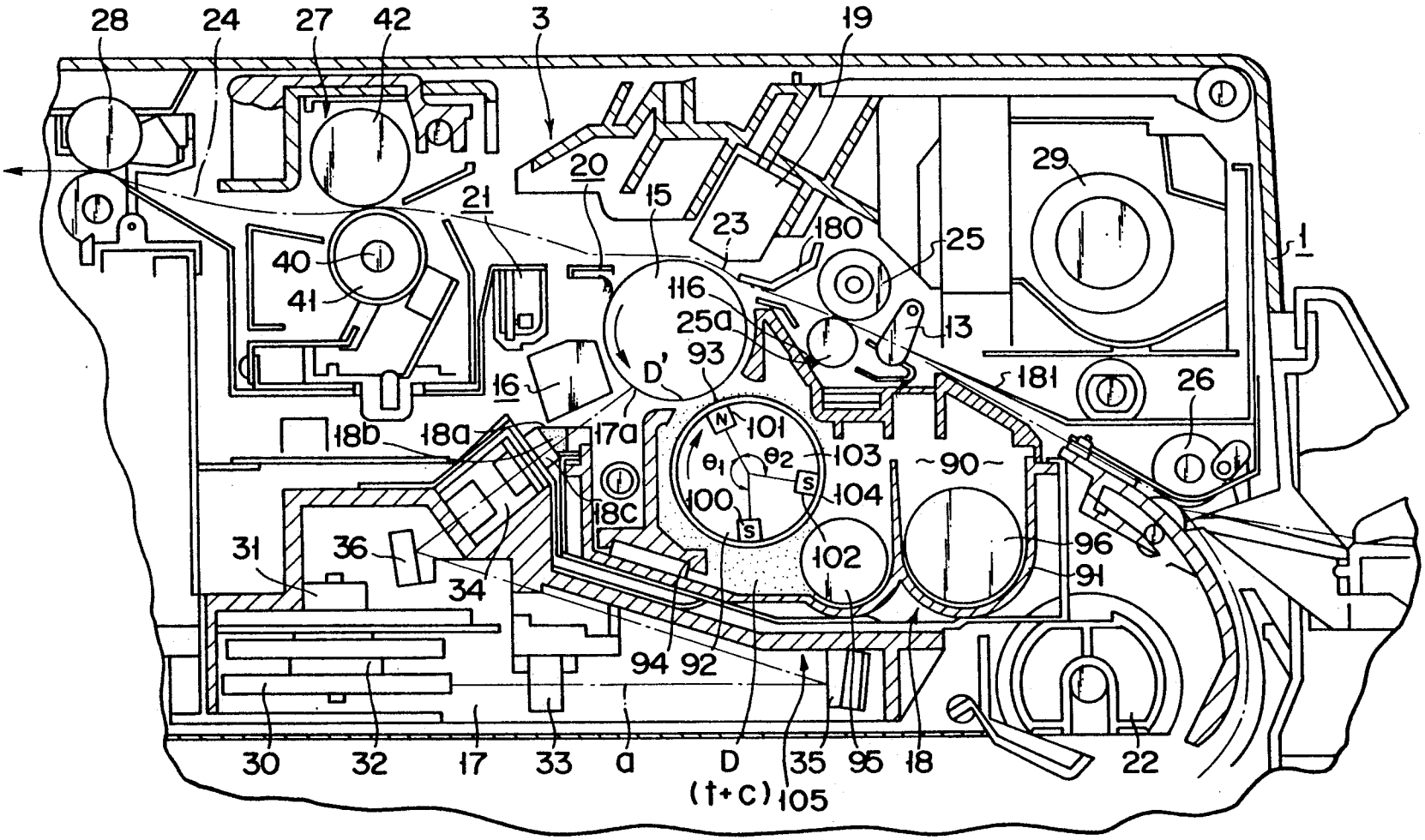

FIGS. 1 and 2 show an electrophotographic image forming apparatus (laser printer) using a semiconductor laser. The image forming apparatus is connected to a host system (not shown) for used as an external output apparatus, such as a computer or word processor, via a transmission controller, such as an interface circuit. On receiving a print start signal through the host system, the apparatus starts image forming operation, so that an image is outputted and is recorded on a paper as a recording medium.

The image forming apparatus comprises a housing 1, and an electrophotographic processing unit 3 for imaging, which is arranged in the rear portion (right-hand portion in FIG. 1) of the housing. A paper discharge section 6 is formed at the upper front portion of the housing 1, and a cassette holding section 8 for holding a paper cassette 7 is defined at the lower portion of the housing 1.

The paper discharging section 6 is formed of a recess in the top surface of the front portion of the housing 1. A rockable discharge tray 9 is attached to the front edge of the discharge section 6 so that it can be folded up on the section 6 or stretched as shown in FIG. 1. A control panel 11 is located on the top face of the housing 1, and a manual-feed tray 12 is attached to the rear face of the housing.

Referring now to FIGS. 1 and 2, the electrophotographic processing unit 3, which executes various electrophotographic process, including charging, exposure, development, transfer, separation, cleaning, fixing, etc., will be described in brief.

A photoconductive drum 15, for use as an image carrier, is located substantially in the center portion or a unit holding section. The drum 15 is surrounded by a charging unit 16 formed of a scorotron, an exposure portion 17*a* of a laser exposure unit 17, for use as exposure means (electrostatic latent image forming means), and a developing unit 18 of a magnetic-brush type capable of simultaneously executing a developing process and a cleaning process. The drum is further surrounded by a transfer unit 19 formed of a scorotron, a memory distributing unit 20 including a brush member, and a pre-exposure unit 21. These surrounding elements are arranged successively in the rotating direction of the drum 15.

A paper transportation path 24 is formed in the housing 1. It is used to guide a paper sheet P, fed from the paper cassette 7 through a sheet feeding unit 22 or manually fed from the manual-feed tray 12, into the paper discharge section 6 on the top side of the housing 1 via an image transfer region 23 between the photoconductive drum 15 and the transfer unit 19. An aligning roller pair 25 and a feed roller pair 26 which constitute feeding means are arranged on the upper-course side of the transfer region 23 of the path 24, while a fixing unit 27 and a discharge roller pair 28 are arranged on the lower-course side. Numeral 13 denotes an aligning switch.

When the apparatus receives the print start signal through the host system, the drum 15 is rotated, and its surface is charged by means of the charging unit 16. Then, the drum surface is exposed to or scanned with a laser beam a by means of the laser exposure unit 17 which includes a polygonal mirror scanner 32. The beam a is modulated in response to dot image data from the host system. Thus, an electrostatic latent image corresponding to an image signal is formed on the drum surface. The latent image is developed and visualized by means of a toner t, as a developing agent, in a magnetic brush D' of the developing unit 18.

In synchronism with the toner image forming operation, the paper sheet P, taken out from the paper cassette 7 or manually fed from the manual-feed tray 12, is delivered into the processing unit 3 via the aligning roller pair 25, and a toner image previously formed on the drum 15 is transferred to the sheet P by the agency of the transfer unit 19. Then, the sheet P is transported along the paper transportation path 24 to be fed into the fixing unit 27. The unit 27 includes a heat roller 41, having a heater lamp 40 therein, and a pressure roller 42 pressed against the roller 41. As the sheet P passes between the rollers 41 and 42, the toner image is fused and fixed to the sheet. Thereafter, the sheet P is discharged into the paper discharging section 6 via the discharge roller pair 28.

After the toner image is transferred to the paper sheet P, toner particles remaining on the surface of the drum 15 are temporarily collected in the memory distributing unit 20, which includes the conductive brush, and then returned to the drum surface so that they leveled.

The following is a detailed description of the construction and operation of the principal units of the image forming apparatus.

In order to simplify the processes of the electrophotographic system, the apparatus of the present invention uses the reversal developing process, in which the exposed portion of the photoconductive drum is developed, and a process (cleaning & developing process or CDP) in which the removal of residual toner particles t and the development are performed simultaneously.

Accordingly, the photoconductive drum 15 is designed as follows.

The drum 15 is formed of an aluminum cylinder with an outside diameter of 30 mm and wall thickness of 0.8 mm and an OPC (organic photoconductor) on the cylinder. The photoconductor includes an electric charge generating layer and an electric charge transportation layer applied successively to the aluminum cylinder.

The drum 15 is charged to −500 V by means of the charging unit 16. When the drum 15 receives the laser beam from the exposure unit 17, the surface potential of its exposed portion is attenuated to −50 V, so that an electrostatic latent image is formed.

As shown in FIG. 2, the laser exposure unit 17 includes a semiconductor laser oscillator (not shown), a polygonal scanner 32 formed of a polygonal mirror 30 and a mirror motor 31, an fθ-lens 33, a compensating lens 34, and reflecting mirrors 35 and 36 for guiding the laser beam a for scanning. The laser beam from unit 17 is adjusted to four times as large or more than as the half decay exposure of the photoconductor.

In order to simplify the processes of the electrophotographic system, as mentioned before, the developing unit 18 uses the reversal developing process and the process (CDP) in which the removal of the residual toner particles t and the development are performed simultaneously.

As shown in FIG. 2, the developing unit 18 has a casing 91 with a developing agent storage portion 90. The casing 91 houses the photoconductive drum 15 and a developing roller 92 opposed thereto. A two-component developing agent D, formed of a toner (coloring powder) t and a carrier (magnetic powder) c is stored in the storage portion 90. A doctor blade 94 for regulating the thickness of the developing agent magnetic brush D' on the surface of the developing roller 92 is provided at the region where the brush D' is in sliding contact with the drum 15, that is, on the upper-course side of a developing position 93 with respect to the rotating direction of the roller 92. First and second developing agent stirrers 95 and 96 are housed in the storage portion 90.

The developing unit 18 is fitted with a toner supply device (not shown), whereby the storage portion 90 is replenished with the toner t as required.

Figure 3:
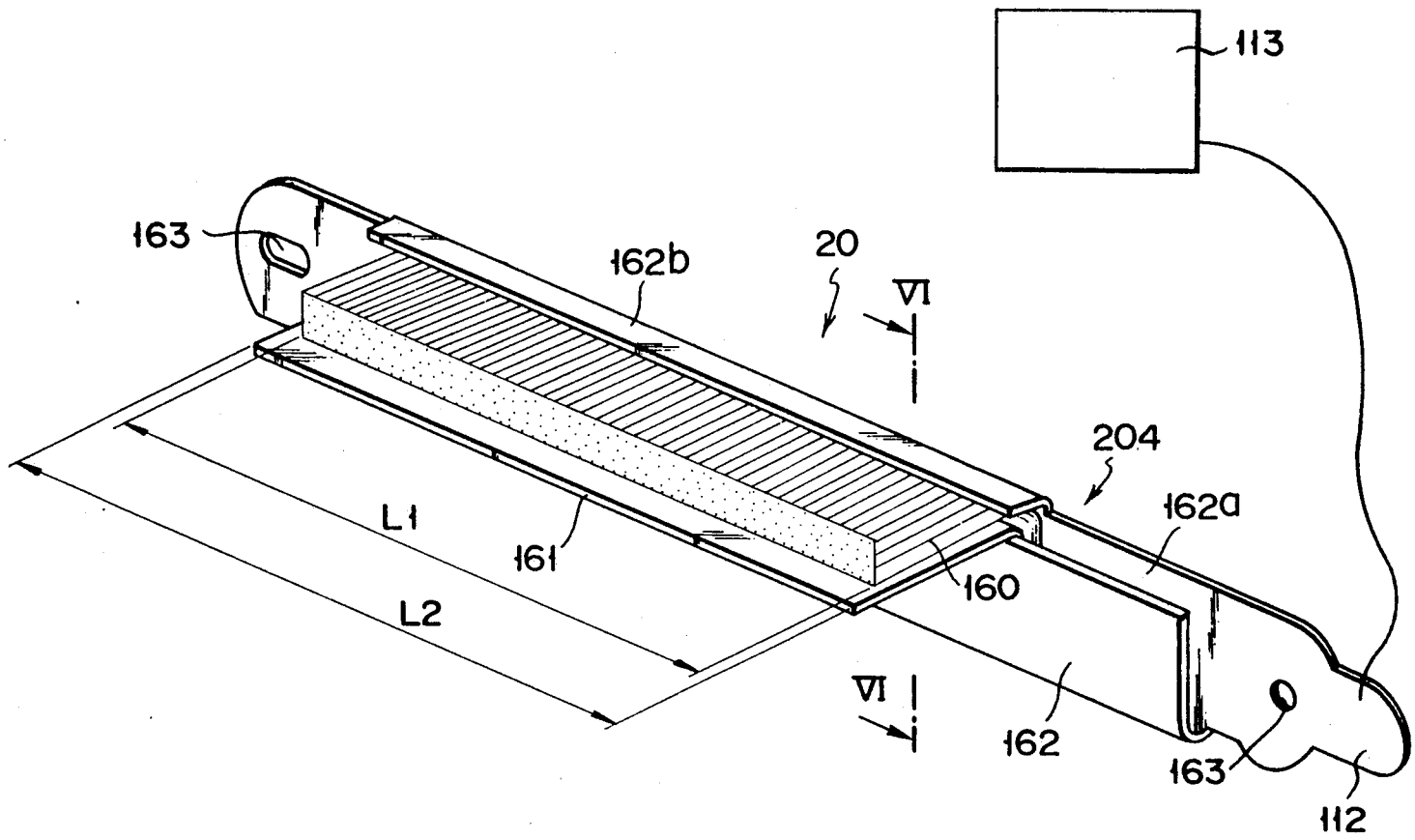

The developing roller 92 is composed of a magnet roller 103, having three magnetic pole portions 100, 101 and 102, and a nonmagnetic sleeve 104 which, fitted on the roller 103, rotates in the clockwise direction of FIGS. 2 and 3. Among the three pole portions 100, 101 and 102 of the magnet roller 103, the pole portion 101, which faces the developing portions 100 and 102 are south poles. The angle θ1 between the pole portions 100 and 101 is set to 150°, while the angle θ2 between the pole portions 101 and 102 is set to 120°. The moment the electrostatic latent image on the photoconductive drum 15 is developed, the unit 18 recovers the residual toner t mechanically and electrically by means of a mechanical scraping force, produced by the magnetic brush effect of the two-component developing agent D, and the potential difference between a charging potential attributable to the reversal development and a developing bias applied to the magnetic brush D'.

The developing unit 18 integrally incorporates the photoconductive drum 15, charging unit 16, memory distributing unit 20, etc., which constitute a processing cartridge 105. The cartridge 105 can be loaded into or unloaded from the housing 1 in the axial direction of the drum 15.

The following is a description of the memory distributing unit 20 for distributing untransferred toner particles remaining on the surface of the photoconductive drum 15 after the transfer, that is, a residual developed image.

Figure 4:
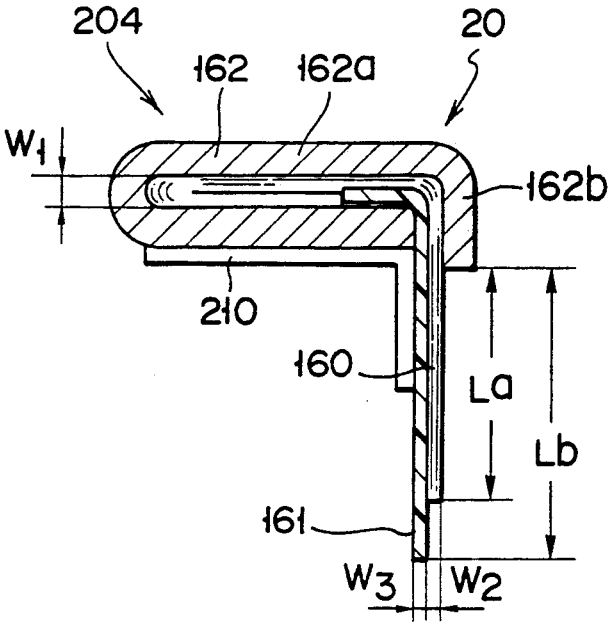
Figure 5:
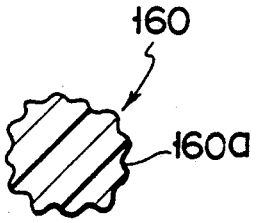

As shown in FIGS. 3 to 5, the memory distributing unit 20 includes a brush 160, in contact with the outer circumferential surface of the drum 15, and a retaining member 204 for retaining the brush 160.

The brush 160 is formed of a large number of conductive artificial fibers in a bundle. These fibers are obtained by dispersing carbon particles, metallic powder, carbonized phenolic resin or the like, or a conductive material, such as stainless-steel fibers, in a resin such as rayon, nylon, acrylic resin, or polyester resin, as a principal ingredient. The artificial fibers are made by, for example, dispersing a suitable amount of carbon particles in the resin solution and extracting the resulting dispersion from an extraction nozzle. The volume resistance of the artificial fibers can be freely selected by changing the amount of dispersed carbon particles. Also, the thickness and cross-sectional shape of the artificial fibers can be suitably changed according to the diameter and shape of the extraction nozzle.

The volume resistance of the artificial fibers preferably ranges from $10^2$ to $10^7$ Ω.cm. If it is lower than $10^2$ Ω.cm, electric discharge is caused between the brush 160 and the photoconductive drum 15, thereby damaging the photoconductive layer of the drum, when a voltage is applied to the brush 160 in order to electrostatically attract the untransferred toner particles, as mentioned later. If the volume resistance is higher than $10^7$ Ω.cm, on the other hand, the untransferred toner particles on the drum 15 cannot be electrostatically attracted even when the voltage is applied to the brush 160. Thus, the untransferred toner particles directly pass the brush 160 and scatter to the outside, so that the effects (mentioned later) of the distributing unit 20 cannot be obtained.

FIG. 5 shows the cross-sectional shape of an artificial fiber. The fiber has indentations **160*a* on its peripheral surface, which extend substantially continuously in the longitudinal direction of the fiber. Thus, each artificial fiber has a wide surface area, and maintains a linear directional property in the longitudinal direction. When the brush 160 is brought oppositely in contact with the circumferential surface of the drum 15, therefore, it can touch more residual toner particles on the drum 15, and not tend to curl. Accordingly, the effects (mentioned later) of the brush 160** can be heightened, and the brush can stand prolonged use.

The thickness of the artificial fibers preferably ranges from 1 to 50 deniers. If it is smaller than 1 denier, the fibers may be liable to be broken or slip out of the retaining member 204, so that the brush 160 cannot endure prolonged use. If the fiber thickness is greater than 50 deniers, on the other hand, the artificial fibers must be coarsely bundled, so that the untransferred toner particles t pass the brush 160 without fully touching the same, even though the fibers are brought into contact with the drum 15. Thus, the proper effects of the brush 160 cannot be obtained.

In the present embodiment, the brush 160 is formed in the following manner. First, a plurality of bundles of artificial fibers are prepared, each including 100 fibers that are formed by dispersing carbon in rayon and have a volume resistance $10^6$ Ω.cm and a thickness of 6 deniers. Then, these fiber bundles are woven into satin-weave structures with a density of 82 bundles per square inch, and the wefts are extracted from two such structures superposed on each other. The brush 160 is in the form of an elongate plate.

Figure 6:
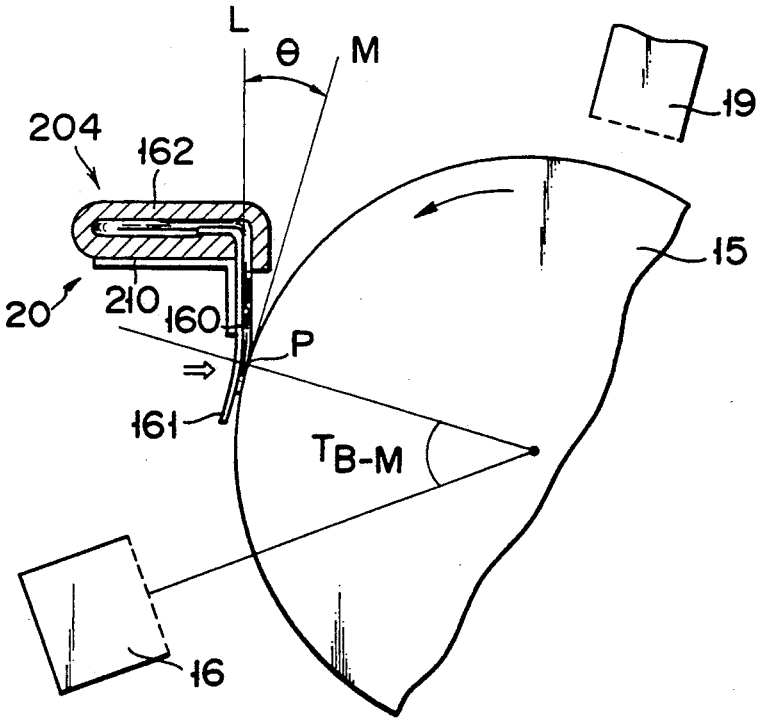

As shown in FIGS. 5 and 6, the retaining member 204 is formed of a retaining fixture 162, a lining member 161, and an auxiliary metal plate 210. The fixture 162 is an elongate plate member formed of conductive metal, e.g., aluminum alloy. The whole structure of the retaining fixture 162 except its two opposite end portions forms a holding potion **162*a* having a U-shaped cross section. One edge portion 162b of the holding portion 162a is bent toward the other edge portion, thus forming an L-shaped configuration. The brush 160 is held in the holding portion 162a of the retaining fixture 162 in a manner such that its upper half portion is folded back U-shaped. The lower half portion of the brush 160 is bent substantially at right angles by means of the two edge portions of the holding portion 162a, and extends substantially perpendicularly from the retaining fixture 162**.

A through hole 163 FIG. 3 is bored through each axial end portion of the retaining fixture 162, and a feeder terminal 112 is formed on one end of the fixture.

The lining member 161 is formed of an elongate elastic plate member. The upper end portion of the member 161, along with the brush 160, is held in the holding portion 162a of the retaining fixture 162, while the remaining portion of the member 161 is bent to an L-shape and extends substantially perpendicularly from the fixture 162. Thus, the lining member 161 extends along the back of the brush 160 or the brush face opposite to that face which is in contact with the photoconductive drum 15. The length Lb of the extending portion of the lining member 161 is greater than the length La of the extending portion of the brush 160, that is, the member 161 extends beyond the free end of the brush. Accordingly, the brush 160 can be prevented from having a tendency of curl. The longitudinal length L2 of the lining member 161 is greater than the length L1 of the brush 160. Since the extension length Lb and longitudinal length L2 of the member 161 are thus made greater than their corresponding lengths La and L1 of the brush 160, the brush 160 can be prevented from disjoining by the member 161, and the toner particles once attracted to the brush 160 can be prevented from scattering. The length L1 of the brush 160 is greater than the length of an image forming region of the drum 15, and the length L2 of the lining member 161 is shorter than the overall axial length of the drum.

The lining member 161 is formed of a particularly elastic or flexible resin material, such as polyester resin. If the drum 15 is touched by the member 161, therefore, drum 15 will be undamaged. In this embodiment, the lining member 161 is formed of a polyester film with a thickness of about 0.1 mm, and projects for a distance of about 1.0 mm from the free end of the brush 160.

The width W1 of the internal space of the holding portion 162a of the retaining fixture 162 is a little greater than the sum of the thickness W2 of the brush 160 and the thickness W3 of the lining member 161. Thus, if W1 is smaller than (W2+W3), the brush 160 may possibly be cut when it is bent at right angles. If W1 is too large, on the other hand, the brush 160 is liable to slip out of the retaining fixture 162.

In order to prevent the brush 160 from slipping out of the retaining fixture 162, a conductive bonding agent may be poured into the gap between the fixture 162 and the brush for reinforcement.

The auxiliary metal plate 210, which has an L-shaped cross section, is fixed to the retaining fixture 162, and is in contact with the lining member 161 on the side opposite to the drum 15. Thus, the metal plate 210 serves to reinforce the member 161 and the brush 160.

The distributing unit 20 constructed in this manner is incorporated in the processing cartridge 105 by means of screws passed individually through holes 163. Thus, the fixture 162, brush 160, and lining member 161 extend parallel to the axis of the photoconductive drum 15. As shown in FIG. 6, moreover, the brush 160, is in contact with that portion of the outer circumferential surface of the drum 15 which is situated between the transfer unit 19 and the charging unit 16, that is, with the photoreceptor layer. The brush 160, in particular, is located so that its side, not its free end, is in contact with the drum 15. In this embodiment, that region of the brush 160 which is situated at a distance of 3 mm from its free end is in contact with the drum 15. Let it be supposed that the center line of the brush 160 fully stretched without receiving any external force is L, the point of the intersection between the center line AL and the outer circumferential surface of the drum 15 in the mounted state is P, and a tangent which touches the outer circumferential surface of the drum 15 at the point P is M. Thereupon, the brush 160 is located so that its mounting angle $\theta$ between the center line L and the tangent M, with respect to the drum 15, is 15°.

In the mounted state, the free end portion of the brush 160, along with the lining member 161, is curved along the outer circumferential surface of the drum 15, and is elastically pressed against the drum by the member 161. When the processing cartridge 105 is loaded into the housing 1, the retaining fixture 162 of the distributing unit 20 is connected to a power supply section 113 in the housing 1 via the power supply terminal 112.

Since the distributing unit 20 is integrally incorporated in the processing cartridge 105, it is always held in a fixed position with respect to the photoconductive drum 15, irrespectively of the cartridge loading or unloading operation.

As mentioned before, the memory distributing unit 20 should preferably be of a fixed type. The reason is that if the brush 160 is rotated or moved from side to side, the attracted toner particles scatter, and a drive system for driving the brush is required, thus entailing an increase in cost.

The following is a description of the Principles and conditions, including experimental data, for the cleaning and developing process, memory distribution process, etc.

The cleaning and developing process (CDP) is characterized by reversal development. If the normal developing system is used, the residual toner particles on the photoconductive drum increase each time the image forming process is repeated, so that black negative memories and white positive memories increase. According to the normal developing system, therefore, it is difficult to perform the cleaning & developing process. In the case of the reversal developing system, the polarity of the toner and the charging polarity are identical, so that the toner polarity cannot be reversed when the drum is charged by means of the charging unit. Thus, the cleaning & developing process can be facilitated.

Figure 7:
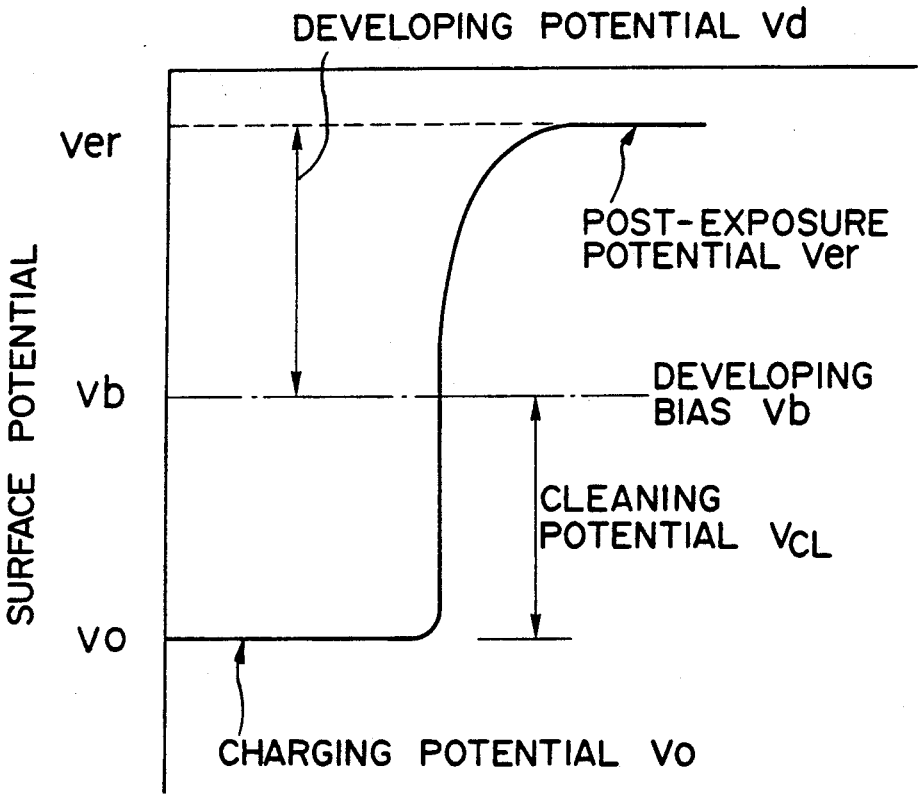

In order to produce a high-quality image, however, the CDP of the present system requires specific processing conditions. FIG. 7 is a diagram for explaining terms used in the description to follow. The charging potential Vo is the surface potential of the photoconductive drum 15 charged by means of the charging unit 16 and located at the developing position 93 without being exposed. The post-exposure potential Ver is the surface potential of the drum 15 exposed by means of the exposure unit 17. The developing bias Vb is a potential applied to the developing roller 94 of the developing unit 18. The developing potential Vd (=Vb−Ver) is the difference between the post-exposure Ver and the developing bias Vb. The cleaning potential $V_{CL}$ (=Vo−Vb) is the difference between the charging potential Vo and the developing bias Vb.

Although the OPC for negative charging is used for the photoconductive drum 15 in the present embodiment, a photoconductor of the positive-charging type may be used for the purpose. In consideration of this circumstance, Vb, Ver, Vb-Ver, and Vo-Vb will be used as absolute values in the description to follow.

Figure 8:
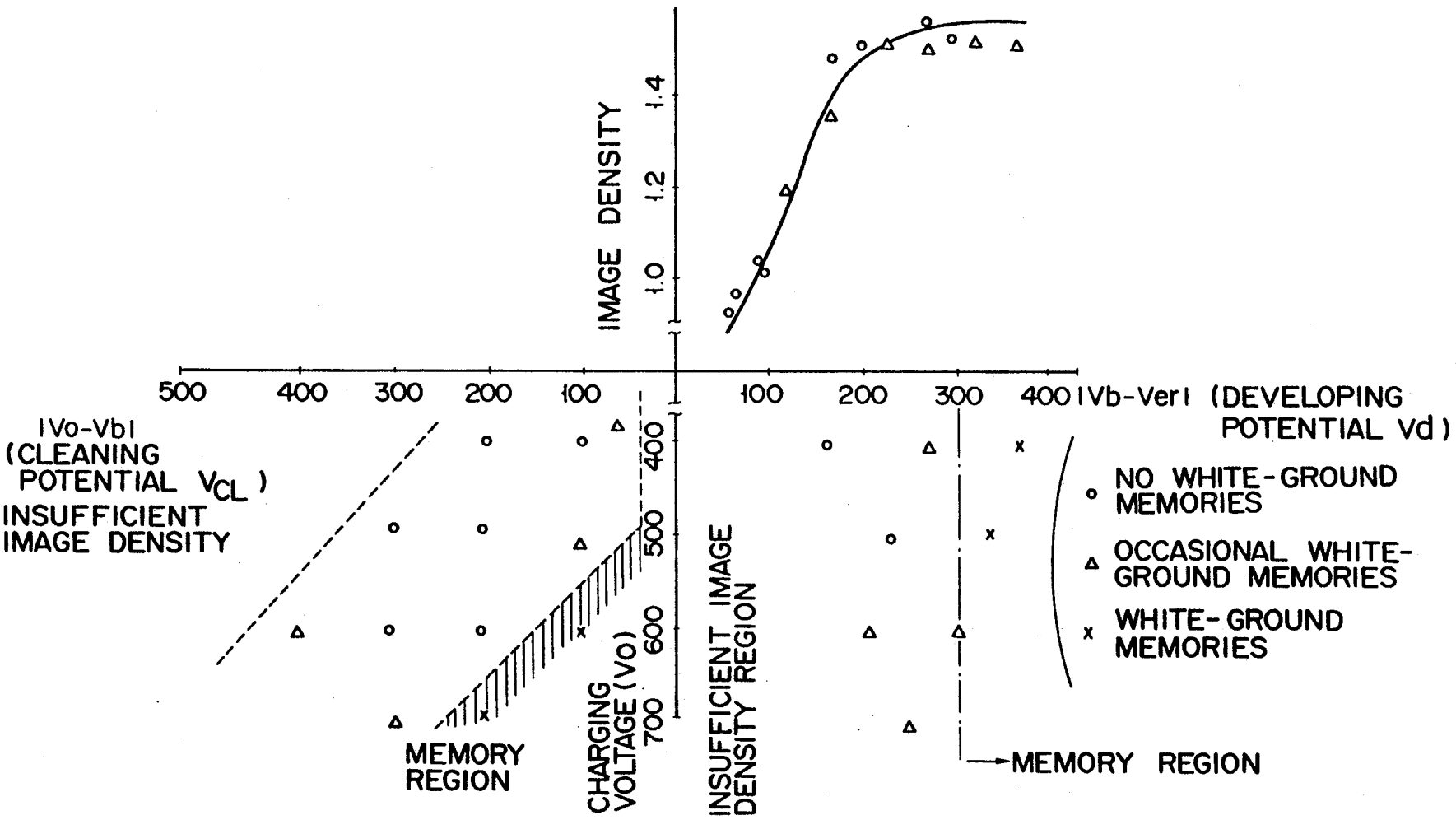

FIG. 8 shows the relationships between the production of memories and various charging potentials. In the first quadrant of this graph, the axes of abscissa and the ordinate represent the developing potential Vb-Ver and the image density, respectively, and measurement data are plotted. This graph indicates that a satisfactory image density of 1.0 or more requires a developing potential of 100 V or more.

In the fourth quadrant, the axes of abscissa and ordinate represent the developing potential Vd and the charging potential Vo, respectively, and each plot mark indicates a memory in an image on the paper sheet P, caused by the previous image formed before the last revolution of the photoreceptor drum 15, due to insufficient cleaning.

It has been found that a black-pattern memory (hereinafter referred to as white-ground memory) develops on a white ground due to insufficient cleaning if the developing potential Vd is higher than 300 V. This may be regarded as attributable to the fact that the actual pickup of the toner t and the residual toner particles increase, although the image density does not, if the developing potential exceeds 300 V.

In the third quadrant, the axes of abscissa and ordinate represent the cleaning potential $V_{CL}$ and the charging potential Vo, respectively, and the production of memory images on the paper sheet P is indicated. It has been found that a white-ground memory is sure to be produced due to insufficient cleaning if the cleaning potential $V_{CL}$ (Vo−Vb) is zero, and the cleaning potential must be 50 V or more.

If the cleaning potential increases, however, a positive electric charge is reversely injected from the developing roller 94 into the toner t, and the toner t, changed from negative to positive, adheres to an unexposed portion (negatively charged portion) of the drum 15. The adhering toner forms a filler, which reduces the amount of exposure at the exposure region 17*a*. Accordingly, the exposure image may become rough, or the previous image formed before the last revolution of the drum 15 develops as a positive memory in the resulting dot pattern. Thus, the maximum cleaning potential, which depends on the toner t, carrier c, and the combination of the toner and the carrier, should preferably be 300 V or less.

The following is a description of the types of memories on the image, peculiar to the cleaning & developing process (CDP), and the causes for the production of memories.

Figure 9:
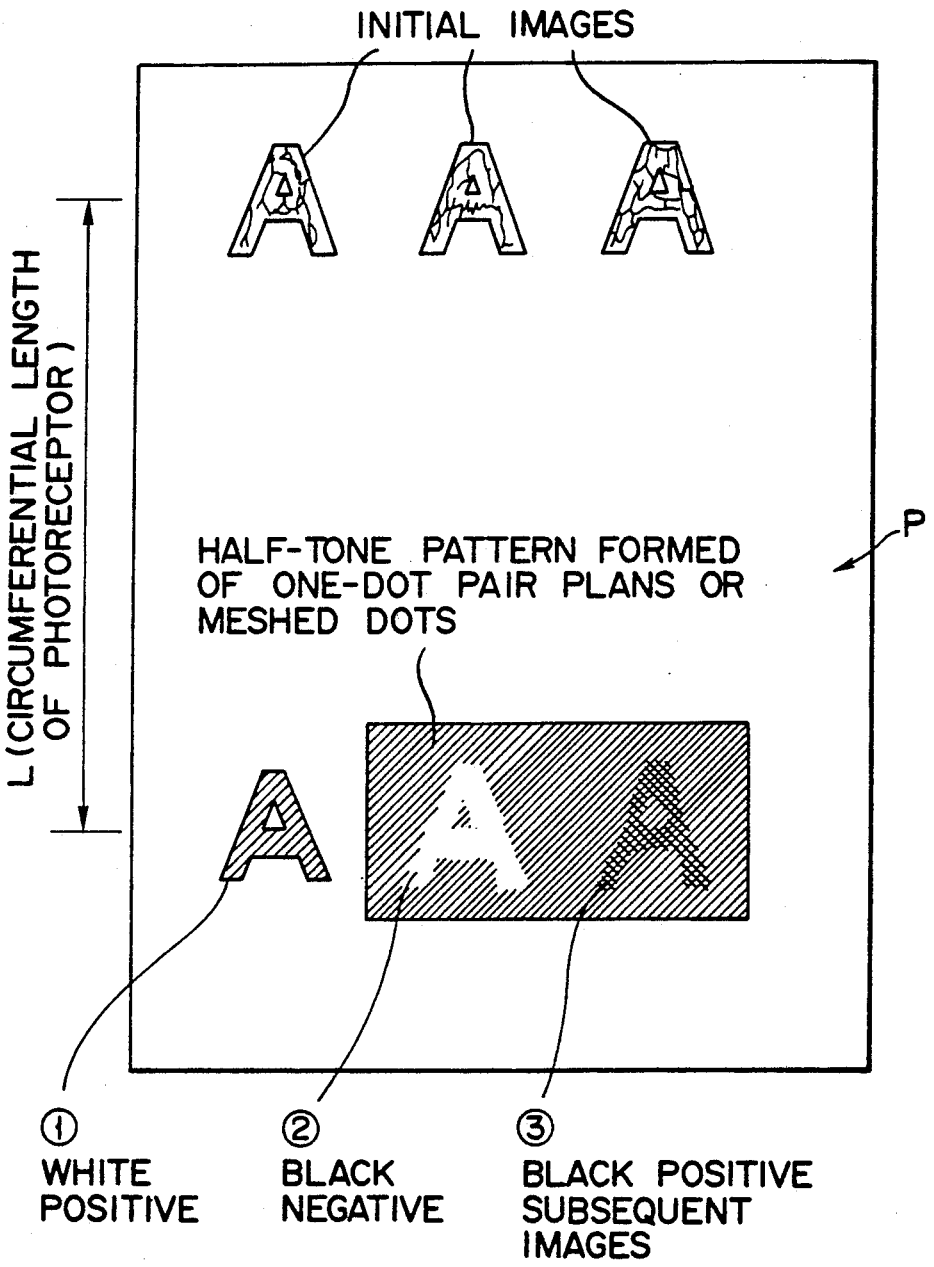

As shown in FIG. 9, there are three types of memories; (1) a black positive pattern (white positive) on a white ground, (2) a negative pattern (black negative) on a half tone formed of the aggregate of dots or lines, and (3) a positive pattern (black positive) on a meshed half tone formed of the aggregate of dots or lines.

The white positive (1), which is attributable to insufficient cleaning, is caused if the cleaning potential $V_{CL}$, the difference between the charging voltage Vo and the developing bias Vb, is too low. The black negative memory (2) is attributable to insufficient exposure caused by a residual toner image. The black positive memory (3) is attributable to too high cleaning potential and low toner resistance.

Figure 10A:
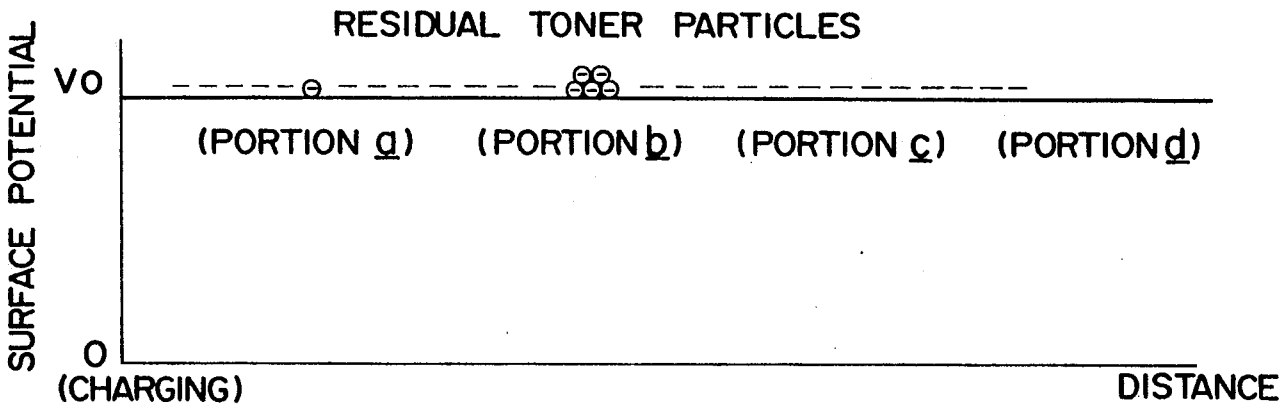
FIGS. 10A to 10C are graphs individually showing the surface potentials of the photoconductive drum in a charging process, an exposing process, and a developing process, respectively.
Figure 10B:
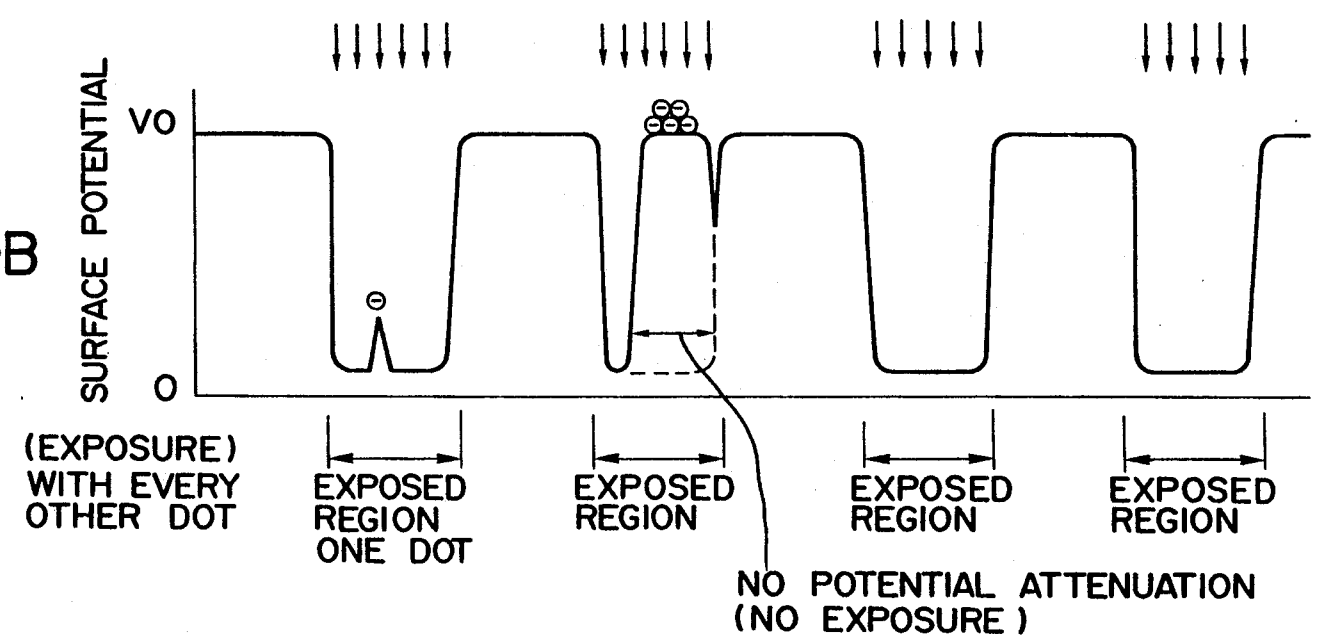
Figure 10C:
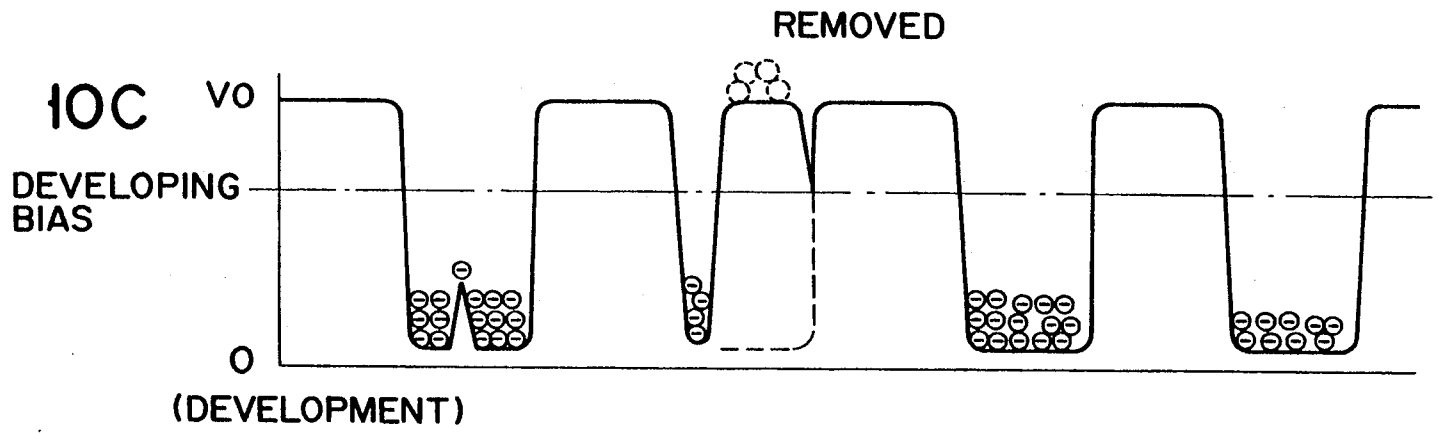

FIGS. 10A to 10C show the principle of production of a black negative memory which is liable to appear on a meshed half tone formed of the aggregate of dots or lines. In each of these drawings, the axes of abscissa and ordinate represent the surface potential and distance, respectively.

FIG. 10A shows the surface potential of the photoconductive drum 15 at a portion a where a few toner particles remain, a portion b where many toner particles remain, and portions c and d where no toner particles remain, after the end of a charging process.

FIG. 10B shows the surface potential of the drum 15 obtained when laser spots are applied to the drum with every other dot. At the portions c and d, which are subjected to normal exposure, the potential is attenuated substantially corresponding to the width of exposure to the laser. At the portion a where few toner particles remain after the transfer, the potential at the regions under the toner particles is considerably attenuated by the effect of transmitted or diffracted rays of light, so that it resembles the potential at the exposed regions where no toner particles exist. At the portion b where many toner particles remain, the photoconductor region under the toner particles is not exposed, and is subjected to no potential attenuation. Thus, there are narrow or no regions in the portion b where the potential is attenuated.

FIG. 10C shows the potential obtained when the formed electrostatic latent image is reversely developed. At the portions c and d where no toner particles remain after the transfer, the toner image is formed on patterns of diameters (widths) substantially equal to the spots for exposure. At the portion b where many toner particles remain, the regions subjected to potential attenuation are narrower than the exposure spots in diameter (width), so that there are small or no developed patterns. Also, the residual toner particles are removed or collected into the developing device. Thus, if a region carrying many residual toner particles forms, such as a character or figure, a black negative memory (memory (2) of FIG. 9) is entailed.

At the portion a dotted with the residual toner particles, the potential at the region under the toner particles is more or less attenuated, so that the toner particles adhere without being removed. Thus, patterns obtained after development are much the same as the ones at the portions c and d, and pattern images with substantially the same diameter (width) as the exposure spots can be obtained. The exposure spot diameter, which is 60 μm (400 dots/inch), is greater than the toner particle diameter (usually from 8 to 12 μm), and the developed toner layer is thick. Even though the potential at the region under the toner particles is not fully attenuated, therefore, this region is buried at the time of development or fixing, thus, arousing no substantial problem, if it is of a size corresponding to one or more toner particles.

As mentioned before, black negative memories are caused by the filter effect of the residual toner particles on the drum. For solid images, meshed images, and five-dot lines (400 dots/inch) or finer lines, the production of black negative memories can be prevented by properly adjusting the laser volume, the arrangement of the photoconductor, the transmission of the toner, etc. Black negative memories are liable to be produced, however, on four-dot lines or coarser lines. These memories are conspicuous at the edge portions of the lines, in particular, and a character composed of four-dot lines or coarser lines may look like a white-trimmed letter.

If a residual pattern of a character image on the photoconductive drum 15 is studied, many toner particles remain at the boundaries between developed and non-developed regions. Since the boundaries hardly transmit light, they may cause black negative memories.

The production of the black negative memories can be prevented by leveling the residual toner particles at the boundaries of the character or line pattern into a memory-free signal layer, that is, by distributing the residual toner particles. Thus, it is necessary to provide the memory distributing unit 20 at a position located on the downstream side of the transfer unit 19 and on the upstream side of the charging unit 16.

The following is a description of the basic principle of operation of the distributing unit 20.

After the transfer process is finished, a predetermined voltage is applied through the retaining fixture 162 to the brush 160 in contact with the photoconductive surface of the drum 15. As a result, the untransferred toner particles remaining on the drum surface are temporarily electrostatically attracted to the brush 160. In this case, the untransferred toner particles are distributed throughout the numerous fibers of the brush 160 without being unevenly attracted to specific portions of the brush. Thereafter, the attracted toner particles are returned and dispersed to the drum surface. Thus, once the amount of the toner attracted to the brush 160 attains the maximum allowable amount the brush 160 can sustain, the brush releases the toner for the portion exceeding the allowable limit and returns it to the drum surface as the brush attracts the toner particles. In this case, the toner particles are released dispersedly and not in lumps. Thus, the untransferred toner particles on the photoconductive drum surface are leveled by the brush 160, that is, the layered toner particles, which may cause black positive memories, are distributed into a single layer.

Various tests were conducted to seek the conditions for the optimum operation of the distributing unit 20.

First, the dependence of the volume resistance of the memory distributing unit 20 on the distribution effect was examined in the following manner. The OPC photoconductive drum 15 of 30 Φ, rotating at a circumferential speed of 36 mm/sec, was pre-exposed by means of the pre-exposure unit 21, and charged to −500 V by means of a scorotron charger for use as the charging unit 16. Then, the developing sleeve 104 of 30 Φ was rotated at a speed of 140 rpm in the same direction as the rotating direction of the drum 15. The moment the electrostatic latent image formed by exposure was developed, the drum was cleaned. Thereafter, the toner image was transferred to the paper sheet P by means of a transfer charger for use as the transfer unit 19.

After the transfer, the drum surface was passed through the brush 160 with a bias voltage applied thereto. Continuous printing was performed with these processes regarded as one cycle, and the resulting transferred images were evaluated.

Figure 11:
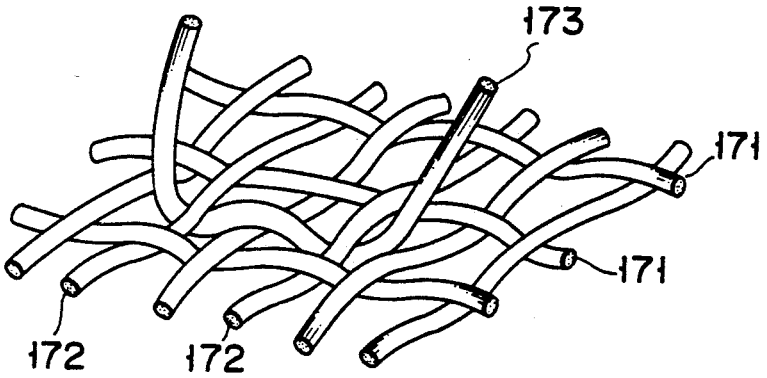
Figure 12:
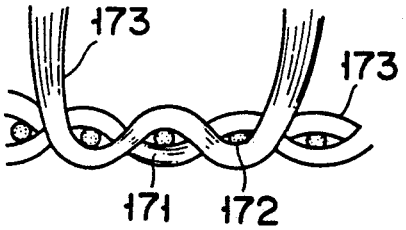

The brushes 160 used in the tests were formed by pile-weaving threads with a density of 100,000 per square inch, the threads each including 100 fibers 3 deniers thick (see FIGS. 11 and 12). In FIGS. 11 and 12, numerals 171, 172 and 173 denote base wefts, base warps, and a pile, respectively. The thickness W2 of one brush 160 used was 3 mm, while that of another was 6 mm. Various volume resistances of the brushes 160 were tried ranging from $10^0$ Ω.cm to $10^{15}$ Ω.cm at 20° C. and 60% RH. Further, three bias voltages, −400 V, 0 V or floating voltage, and +400 V, were applied to the brushes 160.

In consideration of the results of the tests, it is understood that the volume resistance of the brushes 160 should preferably range from $10^3$ Ω.cm to $10^8$ Ω.cm. For the black negative memories, a positive or negative bias had to be applied to the bushes 160.

Figure 13A:
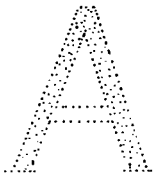
FIG. 13A is a diagram showing a pattern of the residual toner when the bias voltage of the brush is negative.
Figure 13B:
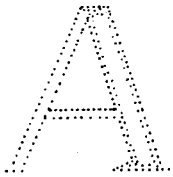
FIG. 13B is a diagram showing a pattern of the residual toner when the bias voltage of the brush is zero or floating.

Residual toner particles having passed through the brush 160 were picked by means of a mending tape. If the bias voltage on the brush 160 is 0 V or floating, as shown in FIG. 13B, the pattern of the residual toner particles, after passing the brush 160, hardly changes or becomes only a little thinner, and memories are produced on the image. If the bias voltage is negative or of the same polarity as the toner t, as shown in FIG. 13A, the boundaries of the character pattern of the residual toner particles are thinned, and the toner-free central portion of the residual pattern is developed by the brush 160. Thus, the resulting character pattern is dense as a whole. In this case, however, no memories appear on the image.

Figure 13C:
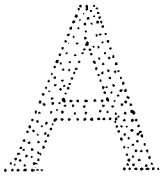
FIG. 13C is a diagram showing a pattern of the residual toner when the bias voltage of the brush is positive.

If a positive bias, opposite to the toner t in polarity, is applied to the brush 160, as shown in FIG. 13*c*, the boundaries of the character pattern are thinned, and no memories are produced on the image. The polarity of the toner t is the polarity obtained through frictional electrification with the carrier c. It was revealed that the brush 160 of the memory distributing unit 20 does not diffuse the character pattern based on the residual toner, but temporarily electrostatically attracts the toner and then naturally discharges it onto the photoconductive drum 15, thereby changing the position of the toner particles adhering to the drum. Thus, once the amount of the toner attracted to the brush 160 attains the maximum allowable amount the brush 160 can sustain, the brush naturally releases the toner for the portion exceeding the allowable limit and returns it to the drum surface as the brush attracts the toner particles.

If the paper is lifted, wrinkled, or dog-eared, transfer errors are caused, so that the untransferred toner particles t cannot enjoy satisfactory cleaning. Against white positive memories attributable to such insufficient cleaning, the bias voltage on the brush 160 was effective only when it was a floating or positive voltage.

Thus, it was ascertained that the bias voltage on the brush 160 must be positive. Accordingly, the effect of elimination of the pattern of the residual toner particles t and the memories on the paper sheet P was examined using the positive bias voltage varying from 100 V to 1,000 V. Thereupon, it was indicated that positive voltages of 100 V or more produced substantially the same effect. It was found, however, that if a voltage of 700 V or more is applied, it leaks due to minor detects (supposedly pin holes) of the OPC (organic photoconductor) photoconductor, thereby burning holes in the photoconductor. Thus, it was indicated that the proper bias voltage for practical use ranges from 100 to 700 V.

Also, as a result of a 20,000 - print running test, white positive memories were produced when it exceeded 15,000 prints (size A4) under low humidity condition. This is because the resistance of the developing agent is increased under low humidity, so that the cleaning bias is lessened and toner t accumulates in the brush 160 of the memory distributing unit 20.

In order to prevent toner t from accumulating in the brush 160, during the time after the brush attracts the transfer residual toner till the next attracting operation is performed, it is necessary to take sufficient time to release the attracted toner particles.

Figure 14:
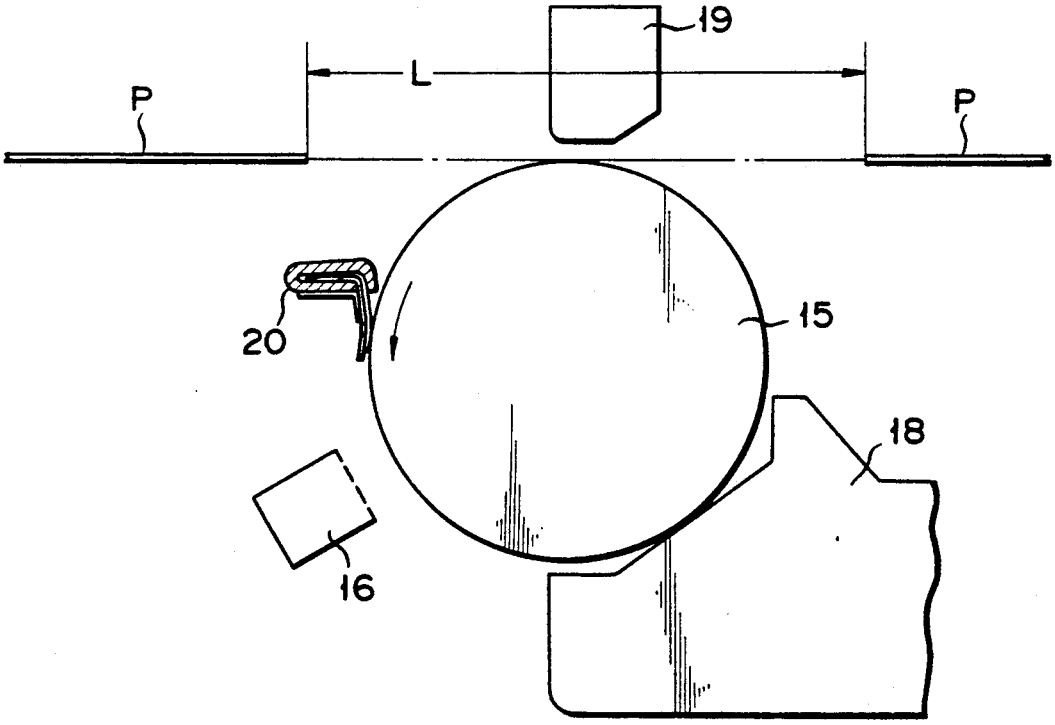

Therefore, as shown in FIG. 14, the distance L between the paper sheets P, which were sequentially fed by the feed roller pair 26 and the aligning roller pair 25 serving as feeding means, was variously changed, thereby, the occurrence of the white positive memories was examined. The distance L corresponds to the length from the trailing end of the toner image formed on the drum surface to the leading end of the toner image formed on the drum surface in the next image forming process, along the outer circumference of the drum. In other words, the distance L corresponds to the time period after the trailing end of the untransferred toner image on the drum surface passes the brush 160 till the leading end of the next untransferred toner image reaches the brush 160. Moreover, during the period between the time the trailing end of the untransferred toner image on the drum surface passes the brush 160 and the time the leading end of the next untransferred toner image asses the brush 160, a voltage of 0 V was applied to the brush to actively release the attracted toner particles.

As a result of this experiment, when the distance L was not set to 40 mm or more, toner was not sufficiently released from the brush 160, so that white positive memories were produced. Therefore, according to the embodiment, the operation of the feeding means was controlled such that the distance L was set to 40 mm or more. Also, during the period between the time the trailing end of the untransferred toner image on the drum surface passes the brush 160 and the time the leading end of the next untransferred toner image passes the brush 160, a voltage of 0 V was applied to the brush 160 two times at an interval of 0.2 seconds, each time for a predetermined period. As a result, toner particles were not accumulated in brush 160 and the excellent result was obtained.

Moreover, the circumferential speed S mm/sec of the photoconductive drum 15 was varied. As a result, it was ascertained that the toner attracted to the brush 160 was sufficiently released when the distance L and the circumferential speed S were set to satisfy the following equations:

$$\text{ti } 40 \leqq L \text{ and } 0.2\ S \leqq L$$

In order to make the apparatus small-sized and low-priced, according to this embodiment, the diameter of the photoconductive drum 15 is as small as 30 Φ, and the paper sheet P is separated from the drum by utilizing its rigidity only. Accordingly, a transfer voltage from the transfer unit 19 is applied to those portions of the surface of the drum 15 which are free from the passage of the paper sheet P, and the free portions are positively charged to 700 to 1,200 V in the vicinity of the transfer grid voltage. It was ascertained, therefore, that the negatively charged toner particles t adhering to the brush 160 develop the positively charged portions of the drum surface which are free from the passage of sheet P.

The toner particles t adhere abundantly to the leading and trailing end portions of the paper sheet P, in particular, thus appearing in the form of streaky white positive or black negative memories on the image. This problem was solved, however, by applying a positive bias to the brush 160, and turning on the power for the transfer unit 19, lest the exposed portions of the photoreceptor drum 15, outside the sheet P, be positively charged.

It was indicated, moreover, that the brush 160 should preferably be formed of satin-weave structures.

Since the positive voltage (opposite to the charging voltage in polarity) is applied to the brush 160, the photoconductive drum 15 is basically charged also positively. Unless that portion of the drum surface which has passed the brush 160, with the voltage thereon, is subjected to a charging corona by means of the charging unit 16, without fail, thereto, the toner t (negatively charged) adheres to that surface portion, thereby producing solid black memories, as the surface portion passes the developing unit 18. Such solid black memories cannot be removed by cleaning.

Accordingly, that portion of the drum 15 negatively charged by means of the brush 160 should be negatively charged by means of the charging unit 16.

If the time the surface portion of the drum 15 in contact with the brush 160 requires before it reaches the charging position is $T_{B\text{-}M}$ (see FIG. 6), the time interval which elapses from the instant that the brush biasing power source 113 is turned on until the charging is started should not exceed $T_{B\text{-}M}$. In the present embodiment, the charging and the brush biasing are simultaneously started. This problem also arises at the end of printing. When printing is finished, therefore, the discharge of the charging unit 16 should not be stopped before the surface portion of the photoconductive drum 15 having so far been in contact with the brush 160 without the brush bias passing the charging position. Thus, the time interval, which elapses from the instant that the brush biasing source is turned off until the charging is stopped, must be longer than $T_{B\text{-}M}$.

In order to investigate the influence of the thickness of each fiber of the brush 160 on the memory elimination effect, produced images and residual toner images on the photoreceptor drum 15, after passing the brush, were examined using varied fiber thicknesses. Thereupon, some memories, especially memories on vertical lines, were not able to be eliminated when the fiber thickness exceeded 100 deniers. When the fiber thickness was 100 deniers or less, on memories were produced, and there were no dense portions at the boundaries in the residual toner images. Thus, the fiber thickness should preferably be 100 deniers or less.

Further, the dependence of the memory elimination effect on the density of the brushes 160 was examined. Thereupon, it was ascertained that a piled brush cannot produce an effect unless it has a density of 1,000 fibers or more per square inch and a thickness of 0.5 mm or more. It was found, moreover, that a satin-weave brush is subjected to unevenness in its memory distribution effect unless it is formed of fiber bundles, each including 10 to 1,000 fibers, as warps or wefts interwoven with a density of 10 bundles per square inch.

As described above, it was ascertained that although the memory distribution effect is substantially determined by the volume resistance, the time for releasing the attracted toner particles, fiber thickness, density, etc, of the brush, the fall (scattering) of the toner particles, in the practical use of the apparatus, is actually influenced by the shape of the brush and the manner of holding the brush against the photoconductive drum 15. Thus, the toner particles once attracted to the brush 160 should preferably be retained by the brush until they are returned to the drum surface. If the toner particles scatter toward any other members than the drum 15 without being retained by the brush 160, the inside of the apparatus housing, charging unit 16, etc. may be soiled by the toner.

Thereupon, the amount of the toner t scattered or dropped onto the charging unit 16, formed of the scorotron, was examined after making 1,000 prints (size A4, set sideways) by using a brush. In doing this, the extension length La, thickness W2 (number of piles for satin-weave), mounting angle $\theta$, contact point P (FIGS. 4 and 6) were varied.

As a result, it was ascertained that the brush works best if the extension length La of the brush is 4 mm or more, the distance from the contact point P to the brush edge is 1 mm or more, and the mounting angle $\theta$ is 45° or less. The effect of restraining the fall of the toner was small under the conditions.

Toner did not fall after making 300,000 prints when the lining member 161 for pressing the brush 160 against the surface of the photoreceptor drum 15 was provided on the brush face on the side opposite to the drum, shown in FIG. 6. It was ascertained that the brush 160 can be prevented from vibrating and disjoining or spreading out by being pressed against the drum surface by means of the lining member 161, whereby the toner particles can be prevented from scattering. This is because if the brush 160 widens toward the end, the toner particles t closely adhere to the individual fibers with the diameter of tens of microns, so that the toner particles are caused to fall and scatter by a vibration or a subtle change of a current of air.

The lining member 160, which should be 2 mm or less in thickness, may be formed of any suitable materials, such as polyester, urethane, high-density polyethylene, polypropylene, butadiene rubber, butyl rubber, silicone rubber, polyacetal, fluoroplastics, etc., which have electrical insulating properties and elasticity. The tip end of the lining member 161 should be flush with or project beyond that of the brush 160 (by 1.5 mm in the present invention), and cannot produce any effect if it is recessed. Preferably, moreover, the length L2 of the member 161 should be greater than the length L1 of the brush 160. In this case, the toner particles can be securely prevented from scattering from the brush to the rear side thereof.

If the various requirements described above are fulfilled, the residual toner on the photoconductive drum 15 can be satisfactorily distributed by means of the memory distributing unit 20.

According to the image forming apparatus constructed in this manner, the untransferred toner particles remaining on the surface of the photoconductive drum 15 are temporarily removed therefrom and then returned thereto by means of the memory distributing unit 20, after the transfer process using the transfer unit 19 and before the charging process in the next image forming cycle using the charging unit 16. Thus, the untransferred toner particles on the drum 15 are leveled, so that the influences of the residual toner after the transfer on the charging and exposure processes can be prevented.

Moreover, when the circumferential speed of the photoconductive drum 15 is S mm/sec, the distance L between any two adjacent paper sheets P, which are sequentially fed to the portion between the drum 15 and the transfer unit 19, is set to satisfy $40 \leqq L$ and $0.4\,S \leqq L$. Thus, the brush 160 of the distributing unit 20 can sufficiently release the attracted residual toner particles, thereby preventing residual toner particles from accumulating in the brush. Therefore, the distributing function of the unit 20 can be stably maintained for a long period of time.

Thus, a cleanerless image forming apparatus can be put into practical use, in which the production of undesired images, due to the residual toner used in the preceding image forming cycle, can be prevented to ensure production of satisfactory images, and the whole apparatus can be reduced in size and cost, and improved in maintenance efficiency.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

means for forming a latent image on an image carrier;

means for developing said latent image with a developing agent and removing the developing agent remaining on the image carrier while the latent image is developed;

means for transferring the developing image from the image carrier onto a recording medium;

means for distributing any developing agent remaining on the image carrier so as to level the remaining developing agent after the transfer of the developed image; and means for feeding recording mediums through the transferring means, with such a predetermined distance maintained between any two adjacent recording mediums to sufficiently release the developing agent, attracted in the distributing operation, to the image carrier.

2. An apparatus according to claim 1, wherein said distance is set to satisfy the following equations:

$$40 \leqq L \quad \text{and} \quad 0.4\,S \leqq L,$$

where L (mm) is the distance and S (mm/sec) is a circumferential speed of the image carrier.

3. An apparatus according to claim 1, wherein said distributing means includes a bundle of electrically conductive fibers in contact with the image carrier, and means for applying a predetermined voltage to the fiber bundle to attract the developing agent remaining on the image carrier.

4. An apparatus according to claim 3, wherein said distributing means has means for retaining said fiber bundle, and said fiber bundle is in the form of a brush extending from the retaining means, and has a free end separate from the retaining means and extending in an axial direction of said image carrier.

5. An apparatus according to claim 3, wherein said applying means has means for applying a voltage of 0 V to the fiber bundle two times at a predetermined interval, each time for a predetermined period, during the period between the time the trailing end of the untransferred developing agent image on said image carrier passes said distributing means and the time the leading end of the next untransferred developing agent image passes said distributing means.

6. An image forming apparatus comprising:

means for forming a latent image on an image carrier;

means for developing said latent image with a developing agent and removing, from the image carrier, the developing agent remaining on the image carrier while the latent image is developed;

means for transferring the developed image from the image carrier onto a recording medium; and means for feeding recording mediums through said transferring means, with a predetermined distance L (mm) maintained between any two adjacent recording mediums, said predetermined distance L is set to satisfy the following equations:

$$40 \leqq L \quad \text{and} \quad 0.4\,S \leqq L,$$

where S (mm/sec) is a circumferential speed of the image carrier.

7. An apparatus according to claim 6, which further comprises means for distributing any developing agent remaining on the image carrier after the transfer of the developed image.

8. An apparatus according to claim 7, wherein said distributing means includes a bundle of electrically conductive fibers in contact with the image carrier, and means for applying a predetermined voltage to the fiber bundle to attract the developing agent remaining on the image carrier.

9. An image forming apparatus comprising:

means for forming a latent image on an image carrier;

means for developing said latent image with a developing agent and removing the developing agent remaining on the image carrier while the latent image is developed;

means for transferring the developing image from the image carrier onto a recording medium;

means for distributing any developing agent remaining on the image carrier after the transfer of the developed image; and means for feeding recording mediums through the transferring means, with a predetermining distance L (mm) maintained between any two adjacent recording means, said predetermined distance L is set to satisfy the following equations:

$$40 \leqq L \text{ and } 0.4\,S \leqq L$$

where S (mm/sec) is a circumferential speed of the image carrier.

10. An image forming apparatus comprising:

means for forming a latent image on an image carrier;

means for developing said latent image with a developing agent and removing the developing agent remaining on the image carrier while the latent image is developed;

means for transferring the developing image from the image carrier onto a recording medium;

means for distributing any developing agent remaining on the image carrier after the transfer of the developed image, the distributing means including a bundle of electrically conductive fibers in contact with the image carrier and means for applying a predetermined voltage to the fiber bundle to attract the developing agent remaining on the image carrier, the applying means including means for applying a voltage of 0 V to the fiber bundle two times at a predetermined interval, each time for a predetermined period, during the period between the time the trailing end of the untransferred developing agent image on said image carrier passes the distributing means and the time the leading end of the next untransferred developing agent image passes the distributing means; and means for feeding recording mediums through the transferring means, with such a distance maintained between any two adjacent recording means, that is enough to sufficiently release the developing agent, attracted in the distributing means under the distributing operation, from the distributing means to the image carrier.

* * * * *